US005452484A

United States Patent [19]

Hill

[11] Patent Number: 5,452,484

[45] Date of Patent: Sep. 26, 1995

[54] SINK ANTI-SPLASH DEVICE

[75] Inventor: Dennis R. Hill, Urbandale, Iowa

[73] Assignee: Iowa Methodist Medical Center, Des Moines, Iowa

[21] Appl. No.: 308,195

[22] Filed: Sep. 19, 1994

Related U.S. Application Data

[63] Continuation of Ser. No. 43,222, Apr. 6, 1993, abandoned.

[51] Int. Cl.[6] ..... E03C 1/181

[52] U.S. Cl. ..... 4/658; 141/339

[58] Field of Search ..... 4/654, 657, 658, 4/661, 300.3, 309; 141/339, 343; 134/182

[56] References Cited

U.S. PATENT DOCUMENTS

| | | | |
|---|---|---|---|
| 302,777 | 7/1884 | Reinhold . | |
| 471,578 | 3/1892 | Strater | 4/658 X |
| 978,913 | 12/1910 | Madden . | |
| 998,149 | 7/1911 | Barrett . | |
| 3,334,574 | 6/1964 | Douglas . | |
| 4,205,710 | 6/1980 | Dunicz | 141/9 |
| 4,574,400 | 3/1986 | Annowsky | 4/309 X |
| 4,949,405 | 8/1990 | Johnson | 4/283 X |
| 5,080,149 | 1/1992 | Peoples | 141/337 |
| 5,146,957 | 9/1992 | Belokin, Jr. | 141/1 |
| 5,224,222 | 7/1993 | Jones | 4/301 |

FOREIGN PATENT DOCUMENTS

| | | | |
|---|---|---|---|
| 1109185 | 7/1954 | France . | |
| 1202004 | 9/1958 | France . | |
| 0063860 | 8/1892 | Germany | 4/658 |

*Primary Examiner*—Charles E. Phillips
*Attorney, Agent, or Firm*—Zarley, McKee, Thomte, Voorhees & Sease

[57] ABSTRACT

An anti-splash device for use in sinks. A housing includes an opening for receiving at least a portion of a water stream from a faucet associated with the sink. A base includes a support surface for placing the device on the sink floor and also supports the housing. The device captures and redirects the water stream in a manner which deters splashing and formation of aerosols.

13 Claims, 1 Drawing Sheet

SINK ANTI-SPLASH DEVICE

This is a continuation of application Ser. No. 08/043,222 filed on Apr. 6, 1993 now abandoned.

BACKGROUND OF THE INVENTION

A. Field of the Invention

The present invention relates to ways to prevent splashing in sinks, and in particular, to a device and method for deterring splashing and formation of aerosols in sinks.

B. Problems in the Art

Splashing, even to limited extent, that occurs when water from a faucet strikes the bottom of the sink, or when an object is imposed in the water stream between the faucet and the sink, is many times undesirable. A particular example is as follows.

If potentially hazardous substances are being deposited in the drain of a sink, or devices holding such substances are being washed in the sink, the water stream from the faucet may create splashing or even the creation of aerosols which may bear hazardous substances. This type of problem is recognized in the setting of laboratories which handle infectious matter. Regulations are being developed with respect to these laboratories to require separate sinks be used for hand washing as compared to handling of such matter. Infectious matter is potentially harmful either to touch or contact the skin, as well as to inhalation. Although precautions are generally taken such as wearing gloves and sometimes face masks, such substances are still hazardous.

Water pressure from the water faucet, in combination with water hitting an object or the sink basin floor, present a risk of carrying potentially harmful substances to the person in the form of splashing or aerosols. Laboratory sinks tend to have deep basins with flat basin floors and high faucets. Some faucets utilize aerators to deter splashing, but these are not always helpful, particularly when water is run through the faucet at lower velocities, as is many times desirable.

There is a need, therefore, to reduce or eliminate the risk associated with splashing or formation of aerosols. Difficulties exist in solving such a problem however. The faucet stream can not be entirely shielded or encapsulated because relatively free access is needed to the faucet and the water stream. In fact, substantially the entire ordinary distance or space between faucet and sink basin bottom is needed for rinsing, washing, or otherwise using the sink.

Additionally, any attempted solution needs to take into account that splashing can be caused not only by an unobstructed downwardly directed faucet stream striking sink bottom, but also after striking or running off an object placed in the stream, which water falling to the sink floor may take a different path or be widened or spread before hitting sink bottom.

Still further, a solution should advantageously be adaptable to a variety of different sink configurations and uses, as well as be stable and reliable in such uses.

It is therefore a primary object to the present invention to provide a sink anti-splash device and method which improves upon the state of the art and/or solves the problems in the art.

Another object of the present invention is to provide a device and method as above described which deters splashing in sinks.

Another object of the present invention is to provide a device and method as above described which deters formation of aerosols in sinks.

A still further object of the present invention is to provide a device and method as above described which is stable and reliable in operation.

Another object of the present invention is to provide a device and method as above described which deters splashing and formation of aerosols for water streams of varying widths as well as in many situations where an object is placed in the water stream.

A still further object of the present invention is to provide a device and method as above described which has a relatively low profile so that it does not unduly affect access to the space between the faucet and the bottom of the sink.

Another object of the present invention is to provide a device and method as above described which does not unduly interfere with the drain of the sink.

These and other objects, features, and advantages of the present invention will become more apparent with reference to the accompanying specification and claims.

SUMMARY OF THE INVENTION

The present invention includes a device and method for deterring splashing and formation of aerosols in sinks. The invention intercepts water before it hits the sink bottom to capture or deflect the water that otherwise might cause splashing or creation of aerosols.

DESCRIPTION OF PREFERRED EMBODIMENT

Figure 1:
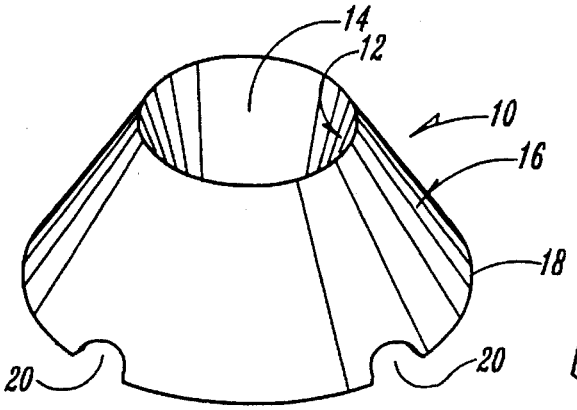
FIG. 1 is a perspective view of a preferred embodiment of the invention.

In order to provide a better understanding of the invention, one specific preferred embodiment will now be described in detail. It is to be understood that this is but one example of a form the invention can take and is not in itself limiting of the scope of the invention.

This detailed description will refer to the appended drawings, namely, FIGS. 1–5. Reference numbers will be utilized in this description to indicate specific parts or locations in the drawings. The same reference numerals will be used throughout the drawings to indicate the same parts and locations unless otherwise indicated.

FIG. 1 illustrates anti-splash device 10. In essence, and for purposes of describing device 10, it will be referred to as being of "double-funnel" construction. A first funnel 12 extends downwardly from opening 14. In the preferred embodiment, the junction between first funnel 12 and second funnel 16 at opening 14 is formed into basically a pointed edge which is generally triangular in cross-section (see particularly FIG. 4). This further minimizes or eliminates splashing by not presenting any substantial flat surfaces generally perpendicular to water falling downwardly on device 10. A second funnel 16 (inverted to first funnel 12) extends upwardly from a lower edge 18 to opening 14. FIG. 1 shows that side openings 20 exist along lower edge 18 of second funnel 16 at spaced apart positions.

Figure 2:
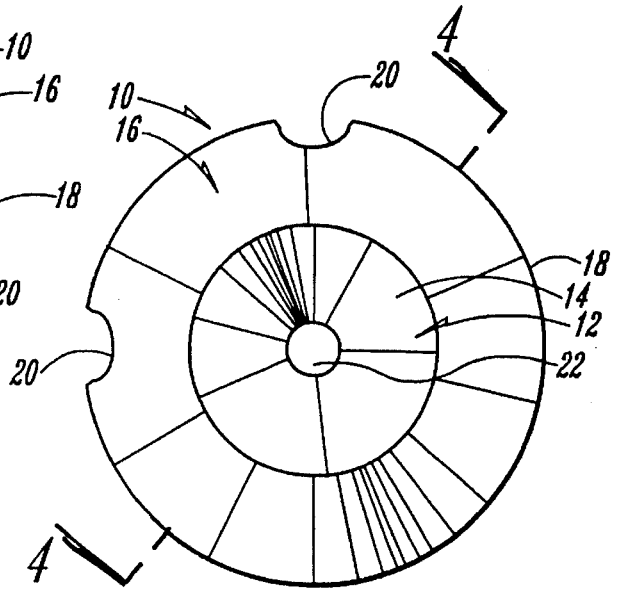
FIG. 2 is a top plan view of FIG. 1.
Figure 3:
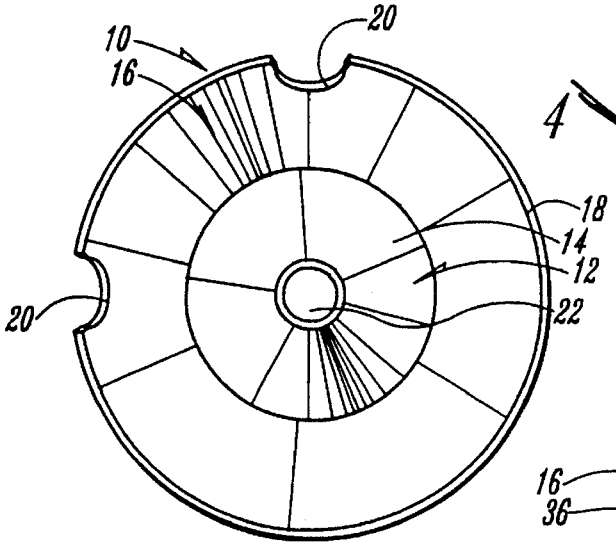
FIG. 3 is a bottom plan view of FIG. 1.
Figure 4:
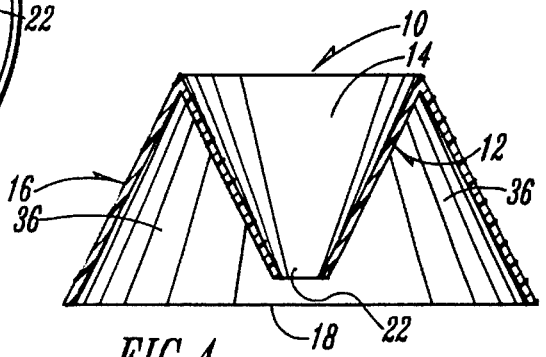
FIG. 4 is a sectional view taken along line 4—4 of FIG. 2.

The exact structure of the double-funnel anti-splash device 10 can be seen more clearly in FIGS. 2–4. The first funnel 12 is held in a suspended position above the plane defined by lower edge 18 of second funnel 16. An opening 22, much narrower than opening 14 exists at the bottom of first funnel 12.

In the preferred embodiment the overall diameter of device 10 is approximately six inches. Opening 14 is approximately three inches in diameter and opening 22 approximately one half inch in diameter. The width of side openings 20 is approximately one inch wide. Other dimensions are possible, however.

Device 10 can be made of variety of types of material. It can be molded out of any water resistant material including ceramics, glass, plastic, composite material, etc. It is to be understood that it is preferred that the material and construction be such that the device have a sufficient weight so that it can not be easily moved by side to side fluctuations in the water stream. However, it is to be understood that the preferred embodiment is somewhat "self-centering", as will be described later.

Figure 5:
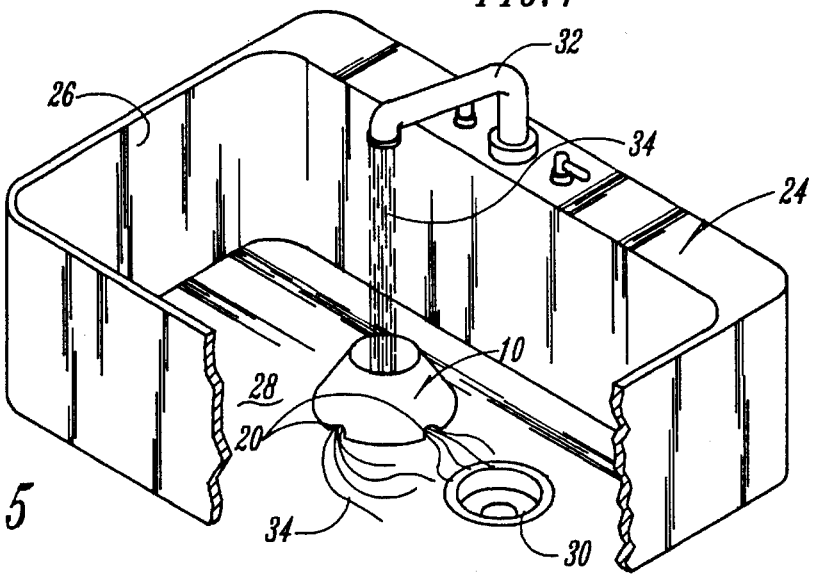
FIG. 5 is a perspective view of the device of FIG. 1 shown in operational position in a sink.

FIG. 5 illustrates device 10 in one position for operation according to the invention. Lab sink 24 includes side wall 26, floor 28, drain opening 30, and faucet 32. Anti-splash device. 10 can be placed so that the lower edge 18 of second funnel 16 rests on floor 28 and is located to receive water stream 34 from faucet 32. Water stream 34 is received into opening 14, which is generally wider than stream 34. First funnel 12 would capture and collect stream 34 so that stream hits the interior side wall of first funnel 12 and exit opening 22 into the interior volume or space 36 between first funnel 12 and second funnel 16 (see FIG. 4). The water would therefore effectively be captured and shielded from splashing outwardly. It in fact collects in space 36 and would exit in a controlled manner from side openings 20 and flow to drain opening 30.

It is to be understood that if an object is placed under water stream 34 and deflects or widens water stream 34, the width of opening 14 is designed to still capture a majority of the downwardly following water. Any water not entering opening 14 would most likely strike the exterior of second funnel 16. The sloped angle of its exterior would cause the water to be deflected at an oblique angle to sink floor 28 thereby also deterring any splashing even if the water does not enter opening 14.

Still further, because of the funnel shape of first funnel 12, the forces related to the water entering opening 14 and being collected and expelled from opening 22 acts as a self centering mechanism for device 10. Additionally, the placement of side openings 20 approximately 90° apart around the diameter of lower edge 18 would also act as kind of counteracting outlets to keep device 10 centered.

The outwardly sloping exterior of second funnel 16 also would assist in the centering function for water striking a portion or portions of that surface of second funnel 16.

It will be appreciated that the present invention can take many forms and embodiments. The true essence and spirit of this invention are defined in the appended claims, and it is not intended that the embodiment of the invention presented herein should limit the scope thereof.

For example, the invention presents a method of basically intercepting water issuing from a faucet in a water stream before it hits the floor of the sink. This includes direct interception of the water stream from the faucet, or intercepting water after all or part of it has been previously disrupted by placing an object in the water stream, such as for example a hand, rinsing a container, etc.

Other features of the preferred embodiment include its self-centering capabilities, the ability to deter splashing of water which is deflected over a relatively wide area, and also the stability of the device.

It is also to be understood that the preferred embodiment can be placed either away from drain opening 30, as shown in FIG. 5, or over drain opening 30. If directly over drain opening 30, side openings 20 would allow any water that is directed to floor 28 of sink 24 to flow into space 36 and then down drain opening 30.

Still further, it is to be understood that side openings 20 could be strategically positioned with respect to the drain. For example, they could be placed like in FIG. 5 where water would directly flow out of openings 20 to drain opening 30. Alternatively, device 10 could be turned so that side openings 20 would cause fluid to exit from openings 20 initially away from drain opening 30, causing it to run around the lower outside edge 18 of second funnel 16 back to drain opening 30.

It is further to be understood that the double funnel configuration of the preferred embodiment of the invention allows a low profile for device 10, leaving substantially unobstructed access to space between faucet 32 and sink floor 28.

I claim:

1. An anti-splash device for use in a sink having a faucet which issues a generally vertical water stream and a sink floor comprising:

a housing having a center axis, a top portion and bottom portion and an outer sidewall;

an entrance opening in the top portion of the housing to receive water from the faucet and fluids and debris traveling to the sink floor;

a chamber defined by an interior wall in the housing to capture at least a portion of the water, fluids, or debris and to deter splashing;

the outer sidewall and interior wall oriented obliquely to the center axis;

the bottom portion having a bottom edge which supports the housing on the sink floor; and one or more openings extending from the bottom edge of the bottom portion upwardly in the outer sidewall of the housing to allow passage of water to and from the housing when the housing is supported on the sink floor.

2. An anti-splash device for sinks comprising:

a device body having a longitudinal axis and including a top and a bottom, the device body being made of a substantially rigid and substantially water proof material, the bottom of the device body supporting the body on a sink floor;

a first funnel shaped piece having a top opening of a first size, a bottom opening of a larger size than the first size, and a side wall extending therebetween;

a second funnel shaped piece having a top opening of a first size, a bottom opening of a smaller size than the first size, and a side wall therebetween;

the second funnel shaped piece extending from the top opening of and substantially enclosing the first funnel shaped piece so that all surfaces of the device body are oblique to the bottom of the sink and to the longitudinal axis through the device body; and one or more openings extending from the bottom of the first funnel upwardly in the sidewall of the first funnel to allow fluid to pass along the sink bottom on opposite sides of the sidewall of the first funnel.

3. An anti-splash device placeable on the floor of a sink comprising:

a funnel shaped member having an upper opening and a bottom narrower opening;

a supporting member extending from attachment to the funnel shaped member at a location along the funnel shaped member down to a support base below the bottom narrower opening of the funnel shaped member to support the funnel shaped member on and in abutment with the sink floor so that the upper opening receives fluid directed therein and the bottom narrower opening is held above the sink floor;

the funnel shaped member and supporting member having surfaces which are oblique to the floor of the sink and to a vertical axis through the device; and a fluid opening in the supporting member between the location of attachment of the supporting member to the funnel shaded member and the abutment of the support base with the sink floor to allow fluid to enter or exit the supporting member when it is supported on the sink floor.

4. A device to deter splashing and the creation of aerosols by water issuing from a faucet into a sink, or by fluids or debris falling by gravity into a sink comprising:

an outer portion having a top and a bottom, and a conically shaped side wall of decreasing cross sectional diameter from top to bottom of the outer portion;

an opening in the top of the outer portion;

a conically shaped inner portion having a top and a bottom, the top of the inner portion connected at the top of the outer portion at the opening and extending towards but not to the bottom of the outer portion and terminating in a smaller opening at the bottom of the inner portion;

one or more openings in the said side wall of the outer portion to allow release of water from inside the outer portion; and so that water issuing from the faucet or fluid or debris falling gravitationally will strike only oblique surfaces on the device to deter splashing and the creation of aerosols, and water, fluid, or debris entering the opening will pass to the smaller opening and then to the sink, but any splashing or aerosols created will be contained in the interior of the device.

5. The device of claim 4 wherein the device has a height substantially less than the distance between faucet and the floor of the sink.

6. The device of claim 4 wherein the ratio of size of the smaller opening to the opening at the top of the outer portion is less than 1 to 4.

7. The device of claim 4 wherein the device is self centering under a stream of water from a faucet by the reaction of a stream of water to the inner and outer portions.

8. A device to deter splashing and creation of aerosols in laboratory sinks having a faucet which issues a stream of water along generally an axis a substantial distance above the sink bottom comprising:

a housing having a faucet-facing side and an opposite side;

all surfaces of the faucet-facing side being oblique to the axis and to the sink bottom so that any splashing or creation of aerosols is deterred as to water, fluid or debris striking the surfaces and as to water, fluid or debris then traveling down the surfaces to the sink bottom;

the housing comprising a substantially rigid, self-standing and self-supporting water proof material sufficient to retain its shape when impacted by the stream, fluid or debris, and to direct water, fluid or debris to the sink bottom;

the housing further comprising a top opening, an interior surface comprised of walls converging to a small opening, and an exterior surface comprising a wall diverging to a supporting portion;

the small opening being spaced inwardly above a plane defining the supporting portion so that splashing or aerosols created by water, fluid or debris falling directly through the small opening and striking the sink bottom are deterred from returning through the small opening and are substantially captured inside the housing; and one or more openings along the wall of the exterior surface.

9. The device of claim 8 wherein the height of the device is substantially less than the distance between the faucet and the sink bottom.

10. The device of claim 8 wherein the interior surface comprises a wall shaped into a funnel.

11. The device of claim 11 wherein the exterior surface comprised a wall shaped in a frusto-conical shape.

12. The device of claim 8 wherein the interior surface and exterior surface are joined at a top edge of the housing, the top edge also being oblique to the axis and sink bottom.

13. The device of claim 8 wherein the small opening is less than one-fourth the diameter of the top opening.

* * * * *